US005167043A

United States Patent [19]

Lopez et al.

[11] Patent Number: 5,167,043

[45] Date of Patent: Dec. 1, 1992

[54] HAND-HELD FORCIBLE ENTRY TOOL

[76] Inventors: Gabriel A. Lopez, 5920 Potomac St., San Diego, Calif. 92139; William L. Jenkins, 3483 Fairway Dr., LaMesa, Calif. 92041

[21] Appl. No.: 680,367

[22] Filed: Apr. 4, 1991

[51] Int. Cl.[5] ..... B25F 1/00; B25D 17/00

[52] U.S. Cl. ..... 7/144; 7/158; 7/161; 173/132; 29/254

[58] Field of Search ..... 7/100, 144, 143, 158, 7/161, 170; 29/254, 247; 173/132, 133, 90, 91; 254/19

[56] References Cited

U.S. PATENT DOCUMENTS

| | | | |
|---|---|---|---|
| 446,622 | 2/1891 | Flanegin | 29/254 |
| 840,580 | 1/1907 | McMillan | 29/247 |
| 3,219,316 | 11/1965 | Fried . | |
| 3,694,918 | 10/1972 | Bailey . | |
| 3,712,390 | 1/1973 | Berg | 173/132 |
| 3,735,822 | 5/1973 | Deike . | |
| 3,747,690 | 7/1973 | Deike . | |
| 3,792,739 | 2/1974 | Deike | 173/121 |
| 4,597,123 | 7/1986 | Cobe . | |
| 4,624,323 | 11/1986 | Burrola | 173/90 |

OTHER PUBLICATIONS

"Innovative Products", p. 56 (lower right hand corner, titled Rip and Ram Breaching Device), Winter, 1991.

*Primary Examiner*—Roscoe V. Parker

*Attorney, Agent, or Firm*—Terry M. Gernstein

[57] ABSTRACT

A forcible entry tool includes a hollow housing having a blind-ended bore defined therein with a stop shoulder located on a fore end of the housing and extending into the bore. A rod is slidably mounted in the housing bore and includes an abutment on a rear end thereof that is impacted by the shoulder when the housing is moved on the rod. The shoulder and the rod abutment are located inside the housing. A work element is attached to the distal end of the rod, and is engaged with a building security device, such as window bars, to pull that security device off of the building when the housing impacts the rod abutment. Various weights and weight distributions can be provided to adjust and customize the tool for the particular job or the particular user. One or more handles can be attached to the housing.

26 Claims, 3 Drawing Sheets

HAND-HELD FORCIBLE ENTRY TOOL

TECHNICAL FIELD OF THE INVENTION

The present invention relates to the general art of hand tools, and to the particular field of hand tools used by personnel such as fireman, policemen and the like to enter a building.

BACKGROUND OF THE INVENTION

Many buildings have either been initially constructed or retrofitted to include security devices on all entryways into the building. Such security devices include bars on windows, metal gates over doors, and the like.

While these security devices are effective in preventing, or at least discouraging, illegal entry into the building, they may create a problem for a law officer or rescue personnel who are trying to gain legal entry into the building. For example, in a small hallway, police may not be able to maneuver sufficiently to remove a gate over a door. Heretofore, these personnel have used battering rams, or grappling hooks connected to a vehicle to gain entry to a building past such security devices. However, battering rams may be ineffective, especially in a small, confined space where there is not sufficient room to maneuver the battering ram in a manner so as to gain enough momentum to crash through the security device. Furthermore, grappling hooks tied to a vehicle may create a danger to personnel near the security device when that security device is pulled off the building. This is especially dangerous if the personnel are in a small area adjacent to the security device. Therefore, in many situations, removal of a building security device should only be effected by a hand-held forcible entry tool.

Special ram devices have been proposed and can be used in a hand-held manner; however, these ram devices have several drawbacks that inhibit entry procedures. For example, some of these ram devices are designed in such as way that effective application of force to a security device being removed cannot be applied. In particular, some of these devices do not permit the device to be manipulated in a manner that most effectively applies the desired force to the security device. Specifically, the ram device cannot be manipulated to efficiently translate ram device movement into high impact forces delivered to the security device. The ram device cannot be moved in a manner that generates great momentum forces, thereby vitiating some of the advantages attributed to the ram device.

Therefore, there is a need for a hand-held forcible entry tool that efficiently translates tool movement into impact force that can be effectively delivered to a building-mounted security device.

Still further many known forcible entry devices are not adaptable to a great number of different situations. For example, because some forcible entry tools do not permit efficient generation of impact forces, many of these tools are not effective in small, confined areas. Still further, many of these forcible entry tools cannot be modified for uses that are different from the uses for which the tool was initially designed. Since many police and rescue personnel face situations that are totally different from all previous situations, these personnel never really know what to expect prior to beginning a job. Therefore, the effectiveness of a particular entry procedure may be inhibited because a forcible entry tool is not fully effective for the particular application at hand, and cannot be quickly modified to be highly effective.

Therefore, there is a need for a hand-held forcible entry tool that is amenable for use in a variety of situations and can be quickly and easily modified to be effective in a wide variety of situations, even situations that may not be envisioned by the manufacturer at the time the tool is initially produced.

Some known forcible entry tools also have open joints and open areas into which dirt or other such tool-jamming substance can move. If the tool is used or stored in a dusty environment, dust particles can become inserted between tool parts that are intended to move with respect to each other. This can damage the tool or cause it to jam. Such situation may cause unreliable operation of the forcible entry tool. Of course, in many situations, unreliable operation of any equipment may be undesirable at best and dangerous to the personnel at worst.

Therefore, there is a need for a hand-held forcible entry tool that is not susceptible to being damaged or jammed by dirt or dust particles, moisture or other such environmental factors.

Because some tools have "open" joints, that is tool parts that move relative to each other are not covered or protected, a user may be exposed to moving parts of the tool during use of that tool. In some cases, a user may be exposed to two tool elements that are intended to collide with great force. If a user's finger or hand is in the wrong place at the time of this collision, the results can be disastrous, including loss of fingers or hands. Since these tools are often used in emergency situations where time is important, and the user is concentrating on other factors, the user should not be called upon to divert some of his attention to being aware of the operation of the tools used in the operation so he can avoid dangerous situations created by the very tools that he is using.

Therefore, there is a need for a hand-held forcible entry tool that is safe to use, even in emergency situations where a user is not concentrating on the tool itself.

OBJECTS OF THE INVENTION

It is a main object of the present invention is to provide a hand-held forcible entry tool that efficiently translates tool movement into high impact forces delivered to a target.

It is another object of the present invention to provide a hand-held forcible entry tool that is amenable for use in a variety of situations and can be quickly and easily modified for many different uses.

It is another object of the present invention to provide a hand-held forcible entry tool that is not susceptible to damage or jamming due to dirt, dust or other environmental factors.

It is another object of the present invention to provide a hand-held forcible entry tool that is safe for an operator to use, even in emergency situations, or when the operator is not concentrating on his use of the tool or where his hands and fingers are during such use.

SUMMARY OF THE INVENTION

These, and other, objects are achieved by a hand-held forcible entry tool that has a closed housing with a rod slidably mounted inside that housing. The housing has a bore defined therein with a stop means on the housing inside the bore near a forward end of that housing. The rod has an abutting means mounted thereon to be located inside the housing bore and which abuts the housing stop means during a portion of the overall operation of the tool. The collision between the rod abutting means and the housing stop means creates an impact force that is transferred to the rod in a manner that efficiently transfers that force to a target, such as a security device. Furthermore, the impact force generating collision occurs inside the housing and the elements that move with respect to each other in order to generate such impact forces are located inside the housing. Therefore, the user is not exposed to the collision of the rod abutting means and the housing stop means, nor are these elements exposed to dirt, dust, moisture or the like during use or storage.

The rod abutting means is located near the rear end of the rod, and the housing stop means is located near the forward end of the housing. Therefore, when the housing stop means collides with the rod abutting means, the housing and rod have moved a maximum distance with respect to each other whereby the momentum associated with the collision will be maximized. Furthermore, both of the colliding elements are located near the longitudinal centerline of the tool. Therefore, the impact forces occur near that centerline, and need not be transferred outwardly and then axially to reach the target. The transfer of the impact forces occurs on nearly a straight line between the impact forces and the target. This makes such transfer as efficient as possible.

Still further, since the impact force between the housing and the rod is generated by pulling the housing, this impact force can be maximized. Greater force can be exerted on the housing by pulling on that housing than by pushing that housing.

Since the impact forces are efficiently generated and transferred to the target using the tool of the present invention, the tool can be used in certain situations that are not receptive to prior tools. A small, confined area is one example of such a situation. If the tool cannot efficiently generate and transfer impact forces to a target, the tool will not be fully effective when used in such small spaces. However, since the tool of the present invention efficiently generates and transfers such impact forces to the target, the tool of the present invention can be used in such small spaces as well as in other spaces.

The tool of the present invention further includes a plurality of working elements, such as hooks, rams and the like and connection means for releasably attaching such working elements to the rod. Since the tool of the present invention is so efficient in its delivery of impact forces to a target, the tool can be used in a wide variety of jobs that may not be possible using prior tools.

BRIEF DESCRIPTION OF THE DRAWING FIGURES

DETAILED DESCRIPTION OF THE PREFERRED EMBODIMENT OF THE INVENTION

Figure 1:
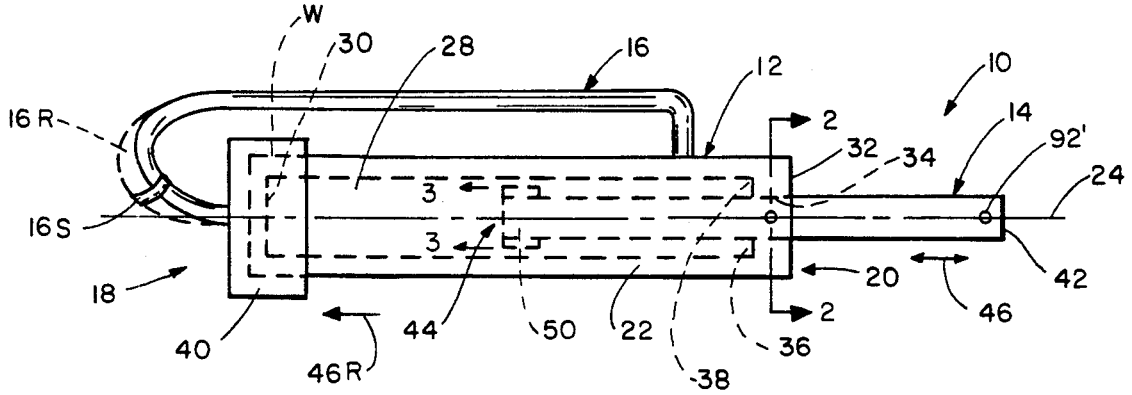
FIG. 1 is a side elevational view of a hand-held forcible entry tool embodying the present invention.

Shown in FIG. 1 is a hand-held forcible entry tool 10 of the present invention. The tool 10 includes a closed housing 12 in which a rod element 14 slides. A handle unit 16 is connected to the housing so one or more users can hold and control the tool during use thereof.

Specifically, the tool housing 12 includes an aft end 18, a fore end 20 and a wall 22 connecting the aft end to the fore end. A longitudinal centerline 24 extends between the housing aft and fore ends. A blind-ended bore 28 extends longitudinally of the housing from the fore end 20 to adjacent to the aft end 18 and has a closed bottom 30 adjacent to the housing aft end. A cover 32 closes the bore on the housing fore end, and has a bore 34 defined therethrough to be centered on the housing longitudinal centerline. The blind-ended bore 28 is thus closed within the housing. As shown in FIG. 1, the cover 32 is one-piece with the housing; however, a separate cap can be used if desired for purposes of disassembling the tool for cleaning or servicing thereof.

A stop means 36 is formed by a shoulder of the housing extending into the blind-ended bore towards the housing longitudinal centerline. The surface 38 of the stop means is an impact-delivering surface as will be understood from the ensuing disclosure.

A cap element 40 is mounted on the housing aft end and can be fixed thereto by welds W, or the like. The cap element has a mass and can be made of material that is heavier than the material of the housing whereby the center of gravity of the housing is shifted toward the housing aft end. The cap can be made of material similar to that of the housing if such rearward shifting of the center of gravity is not desired. The cap element can also include means for releasably attaching that cap element to the housing aft end so various weights can be placed on the housing to suit various users or to suit various situations. Such releasable attaching means can include screw threads on the cap element and mating screw threads on the outside surface of the housing. For example, if the tool 10 is to be used by a single user, the heavy caps may not be desirable; whereas, if the tool is to be used in a situation requiring great momentum from the tool, then heavy caps may be desirable. Shifting the center of gravity toward the aft end of the housing may also be desirable for purposes of balance and movement of the tool.

The handle unit 16 has one end thereof fixed to the housing wall 22 and the other end thereof fixed to the cap 40. If the cap is removable, the handle will be releasably fixed to that cap, as by mating screw threads or the like. The handle has sufficient flexibility when the cap is freed from the housing to permit the cap to be removed. If suitable, the other end of the handle unit can be releasably fixed to the housing wall, as by screw threads on the handle being treadably connected to an internally threaded bore defined in the housing wall. Used in conjunction with a removable connection between the handle and the cap, this last-described feature will permit the handle to be totally removed from the tool if suitable for storage, cleaning or use. Various handles can also be used to change the weight distribution of the tool if suitable. For example, a handle having most of its weight located near the aft end of the housing can be used to further customize the overall tool to the job and to the individual user. A rear-weighted handle 16' is indicated in FIG. 1 in phantom lines and is similar to the handle unit 16 with the exception of the larger portion 16R in the rear of the handle. The portion 16R can be one-piece with the rest of the handle, or can be attached to the handle 16 by any suitable means, such as straps 16S, or the like.

Figure 2:
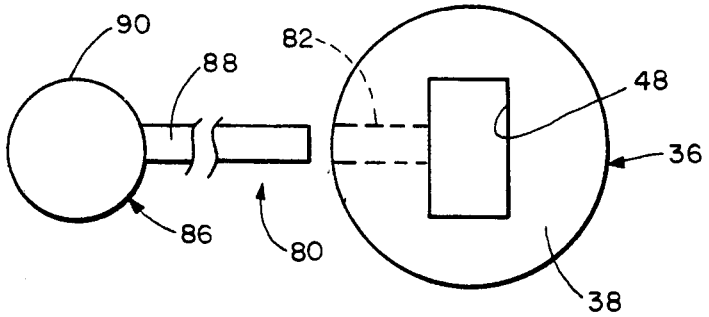
FIG. 2 is an elevational view taken along line 2—2 of FIG. 1.

The rod element 14 is one piece and includes a forward end 42 that is adapted to extend out of the housing fore end and a rear end 44 that is located inside the longitudinal bore 28 and inside the housing. The rod element slides into and out of the housing along the housing longitudinal centerline 24 as is indicated in FIG. 1 by the two-headed arrow 46. The rod element is rectangular in cross section, and, as indicated in FIG. 2, the housing cap element 32 includes a rectangular opening 48 through which the rod element moves.

Figure 3:
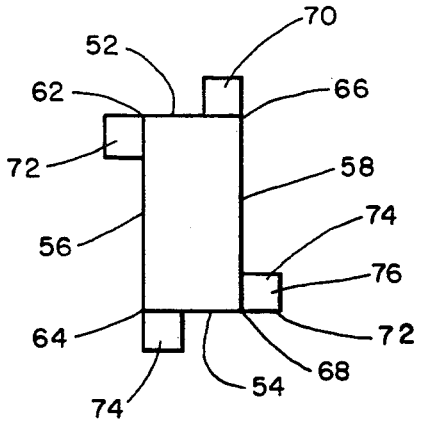
FIG. 3 is an elevational view taken along line 3—3 of FIG. 1.

The rod element includes an abutting means 50 on the rod rear end 44. The abutting means is located inside the bore 28, and is contacted by the housing stop means 36 when the housing is moved far enough rearwardly in direction 46R with respect to the rod element. As is shown in FIG. 3, the rod element includes end edges 52 and 54, and side edges 56 and 58 connecting such end edges together, with corners 62–68 being formed by the intersection of edges 52/56, 54/56, 52/58 and 54/58 respectively. The abutting means 50 includes four projection elements 70–76 on edges 52–58 respectively, each being located adjacent to one corner 66–68 respectively. The projection elements are located immediately adjacent to the rod rear end and extend from that rear end towards the rod forward end for a distance sufficient to provide the elements with enough material to be strong enough to withstand the impacts that will occur between those elements and the housing stop means. Preferably, the rod element and the abutting means are all one-piece and all formed of strong metal material. The elements have widths as measured between the sides thereof that project away from the rod element, such as sides 72 and 74 of element 76 that is less than the dimension of the rod element as measured along the side edge to which the projection element is mounted, in this case, side edge 58. This permits the elements to be strong, yet keeps the weight of the elements as low as possible. As will be understood from the ensuing discussion, this is a desirable feature due to the way in which the tool 10 is used. The rod element is held near the front of the housing during a first portion of the operation, and if the projection elements are too heavy, the weight distribution of the tool may be undesirably affected. During a second phase of tool operation, the rod element may be stationary with respect to the housing, so the weight of the rod element, including the projection elements, is not a significant factor in the above-discussed momentum and impact force considerations. Therefore, in order to keep costs down, as well as to improve the overall operation of the tool, the projection elements are sized as shown in FIG. 3.

The rod is releasably connected to the housing by a connection means 80 that includes a first bore 82 defined through the housing wall and through the stop means 36 and intersecting the bore 28, and a second bore in the rod element. The second bore in the rod element is centered with the first bore in the housing in FIG. 1. A connection pin 86 includes a body 88 that extends through the first and second bores to lock the rod to the housing, and a pull ring 90 that is used to withdraw the pin 86 from the bores. When the pin 86 is in place in the coincident first and second bores, the rod element is locked to the housing and is stationary with respect to that housing. In the preferred embodiment, the rod bore is located approximately midway between the rod element forward end and the rod element rear end. The rod element also includes a work element attaching bore 92 defined therethrough adjacent to the forward end of the rod element. A suitable work element is attached to the rod forward end, with examples of such work elements being disclosed below.

The tool 10 is used by first fixing a suitable work element to the rod element, then fixing the rod element 14 to the housing 12 using the connection means 80. The tool is then swung in the manner of a battering ram to jam the work element between a building security device, such as window bars, or the like, and the building frame surrounding that security device. The weight of the tool provides the momentum necessary to produce a great deal of impact force when the work element contacts the building adjacent to the security device. The weight of the tool is distributed as discussed above so the tool is quite accurate and is aimed to contact the building at the spot precisely located to position the tool for the next phase of operation. As above discussed, the weight of the tool is adjusted and the distribution thereof is adjusted for the most effective use and accurate aiming of the tool for the particular job and to meet the specific requirements of the particular user. A great deal of force will be directed along the tool longitudinal centerline 24 and need not be redirected within the tool. The force application of the tool during this phase of operation is therefore quite efficient.

The tool is then twisted to engage the security device from within the building frame. The connection means 80 is withdrawn to free the housing to move with respect to the security device attached rod element. The housing is then moved violently and rapidly backwards, in direction 46R with respect to the rod element. The backward movement of the housing will continue until the housing stop means 36 impacts the rod element abutting means 50. The weight of the housing and the velocity thereof with respect to the rod element is thus translated into impact force applied to the rod element. This impact force is transferred by the rod element to the security device in a direction that tends to pull the security device out of the building. As discussed above, the location and orientation of the stop means and the abutting means permits a safe, reliable operation that efficiently transfers a great deal of kinetic energy to the rod element and hence to the removal of the security device.

Figure 4:
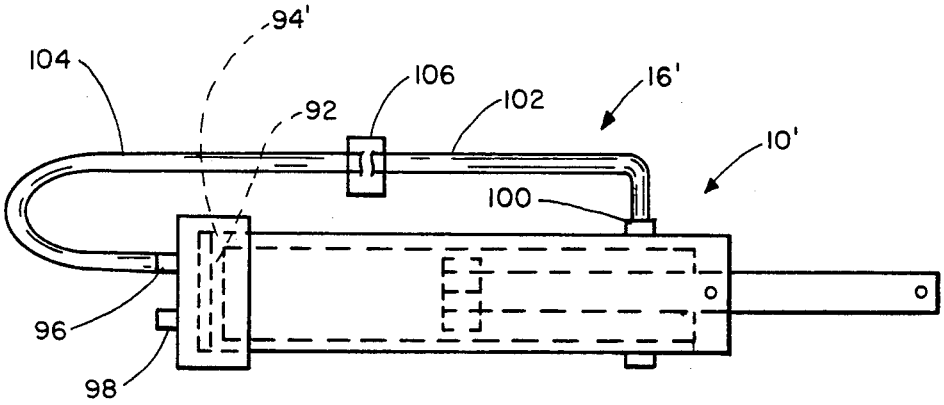
FIG. 4 is a side elevational view of an alternative form of the hand-held forcible entry tool of the present invention.
Figure 5:
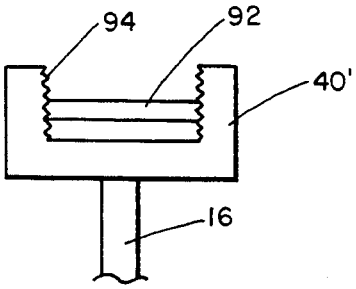
FIG. 5 is an cutaway elevational view of a cap that is used on the tool of the present invention to modify the operation of the tool.

An alternative form of tool 10 is shown in FIGS. 4 and 5 as tool 10'. The tool 10' is similar to tool 10 except that cap 40' of tool 10' differs from the cap 40 of tool 10 and handle unit 16' of tool 10' differs from the handle unit 16 of the tool 10. The cap 40' includes discs 93 that are placed inside the cap and between the cap and the housing aft end to add weight to the rear portion of the housing. This weight is added or removed as desired to adjust the weight, weight distribution and the location of the center of gravity of the tool 10'. The weight discs include screw threads on the outer edge thereof that mate with screw threads 94 of the cap 40'. The screw threads 94 also mate with screw threads 94' on the housing aft end to couple the cap to the housing. The cap 40' further includes two handle attaching elements 96 and 98 in one form, or can have a single handle fixedly attached thereto as shown in FIG. 5. The handle element has screw threads on the end thereof, and the handle attaching elements include internal screw threads that mate with the handle element screw thread to releasably attach the handle to the cap. In the form shown in FIG. 4, one or two handles can be attached to the tool to either add weight to the tool or enable more than one user to operate the tool.

A second handle attaching element 100 is fixed to the housing near the housing fore end and is similar to the handle attaching elements 96 and 98 in having screw threads defined internally thereof which mate with screw threads defined externally of the handle element adjacent to one end of that handle element. As before, the handle element 16' can be fixedly attached to the housing if suitable.

The handle element 16' is divided into a plurality of sections, including forward section 102 connected to the housing and rear section 104 connected to the cap. A coupling element 106 connects to each of the handle sections to connect the sections together. The coupling element has screw threads defined internally thereof that mate with appropriate threads defined externally of the handle sections. The coupling element can be weighted to further control the weight and weight distribution of the tool 10'.

Figure 6:
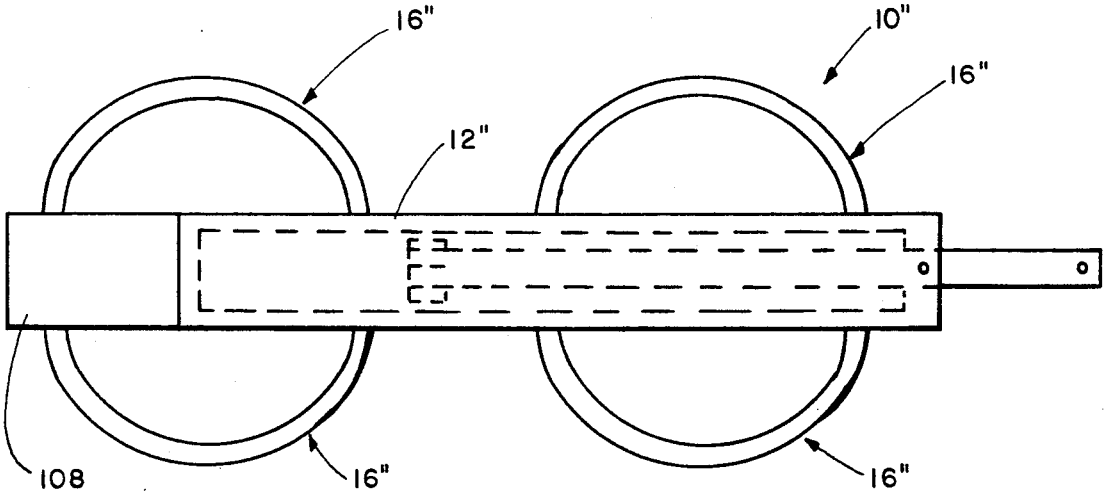
FIG. 6 is a side elevational view of an alternative form of the hand-held forcible entry tool of the present invention.
Figure 7:
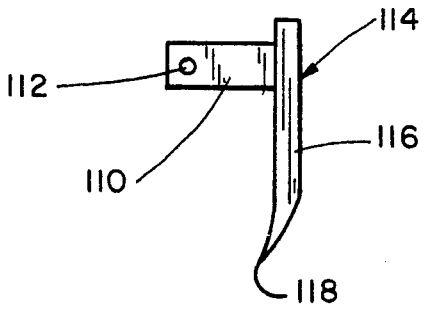
FIG. 7 is a side elevational view of a rhinoceros hook working element used in conjunction with the tool of the present invention.
Figure 8:
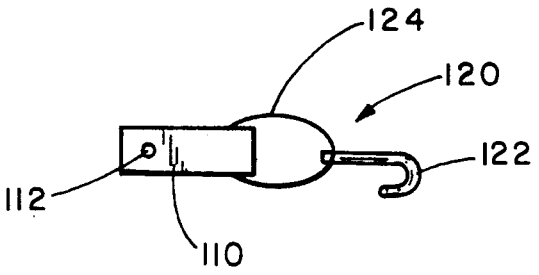
FIG. 8 is a side elevational view of a bail hook working element used in conjunction with the tool of the present invention.
Figure 9:
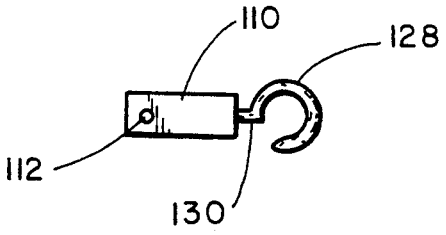
FIG. 9 is a side elevational view of a fixed hook working element used in conjunction with the tool of the present invention.
Figure 10:
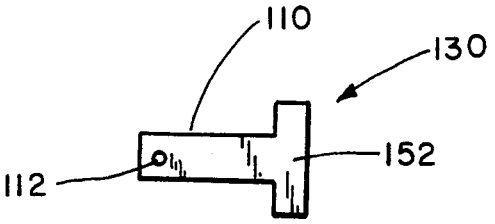
FIG. 10 is a side elevational view of a ram working element used in conjunction with the tool of the present invention.

Shown in FIG. 6 is a tool 10" that is similar to the tools 10 and 10' except that the tool 10" includes four handle units 16", and a rear extension 108 of the housing 12". Two of the handle units are connected at both ends thereof, either permanently or removably, to the housing, and two other of the handle units 16" are connected, either permanently or removably, at one end to the housing and at the other end to the extension 108. The extension is part of the one-piece housing 12", and can be weighted to adjust or control the weight of the housing 12" as above discussed. The tool 10" can be handled by multiple users, and thus can be quite heavy. The tool 10" can be used to breach extremely well built security devices.

Various work elements are illustrated in FIGS. 7–10 and all can be releasably coupled to the rod element forward end by a connection means that includes the rod element bore 92. Each work element includes a sleeve 110 having a blind-ended bore defined longitudinally therethrough, and two transverse bores 112 defined through the sleeve to be centrally aligned with each other. The bores 112 are centrally aligned with the rod element bore 92, and a pin, similar to pin 86, is inserted through the aligned and coincident bores 112 and 92 to fix the work element to the rod element. The work elements can be removed and interchanged with each other, or with other work elements, or the rod forward end left bare as is necessary for any particular job.

As shown in FIGS. 7–10, some of the work elements that can be used in conjunction with the tool embodying the present invention include a rhinoceros hook 114 having a curved body 116 attached to the sleeve 110 to extend to a pointed end 118; a bail hook 120 having a J-shaped hook 122 fixed at a proximal end of the body thereof to a bail 124 that is fixed, either movably or stationarily, to the rod element forward end; a C-shaped hook 128 fixed at a proximal end of a body 130 thereof to the sleeve 112; and a T-shaped ram element 130 having a head portion 132 fixed to the sleeve in a one-piece manner. The hook elements are jammed into the building adjacent to the security device, and twisted to engage the hook with the security device between that security device and the building, and then pulled out of the building in the manner described above. The hook elements, especially the bail hook 120, can also be simply hooked onto the security device and pulled away by slamming the housing against the rod abutting element as described above. In this last-mentioned procedure, the initial ramming of the work element into the building is omitted, and the tool functions as a pulling tool only.

Figure 11:
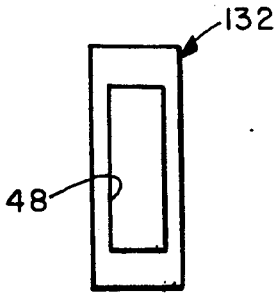
FIG. 11 is a front end elevational view of a tool having a rectangular housing.

As shown in FIG. 11, the tool can include a housing 132 having a rectangular cross section. In fact, many factors, such as manufacturing considerations, handling considerations, and the like, can combine to make the rectangular housing more preferred in many instances than the arcuate housing shown in FIG. 2.

It is understood that while certain forms of the present invention have been illustrated and described herein, it is not to be limited to the specific forms or arrangements of parts described and shown.

We claim:

1. A hand-held forcible entry tool comprising:

A) a hollow housing having (1) an aft end, a fore end and a wall connecting said aft end and said fore end, and a longitudinal axis extending between said aft end and said fore end, (2) a blind-ended bore extending along said longitudinal axis from said fore end toward said aft end and having a bottom adjacent to said aft end, and (3) a stop means on said housing adjacent to said fore end and extending into said bore;

B) a rod element slidably positioned in said bore to move along said longitudinal axis toward and away from said bottom, said rod element slidably extending through said stop means and including (1) a forward end and a rear end, said rear end being positioned within said bore, and (2) an abutment means on said rod element adjacent to said rod element rear end, said abutment means being sized to slidably engage with said housing adjacent to said bore and to abut said stop means while still within said bore; and C) rod connection means for coupling said rod to said housing, said connection means including a first bore extending through said housing wall near said housing fore end, a second bore defined in said rod element and a pin element adapted to extend through said first bore and into said second bore.

2. The forcible entry tool defined in claim 1 wherein said second bore is located approximately midway between said rod element forward end and said rod element rear end.

3. The forcible entry tool defined in claim 1 wherein said abutment means includes a plurality of projections fixed to said rod element.

4. The forcible entry tool defined in claim 3 wherein said rod is rectangular in cross-sectional shape and includes a top edge, a bottom edge, two side edges, and four corners, each corner connecting adjacent side edges together.

5. The forcible entry tool defined in claim 4 wherein each rod element side edge has a length measured between adjacent corners, and each projection has a width measured between adjacent sides of said projection element, with said projection width being less than said side element length.

6. The forcible entry tool defined in claim 3 further including a handle connected to said housing.

7. The forcible entry tool defined in claim 6 further including weight means and connection means for connecting said weight means to said housing near said housing aft end for moving the center of gravity of the housing having the rod element therein and the handle thereon towards said housing aft end.

8. The forcible entry tool defined in claim 7 wherein said weight means includes a cap and said connection means includes screw threads on said cap and on said housing.

9. The forcible entry tool defined in claim 8 wherein said weight means further includes a weighted disc in said cap.

10. The forcible entry tool defined in claim 9 wherein said cap further includes a handle connection means for releasably attaching said handle to said cap, and said housing includes handle connection means for releasably attaching said handle to said housing.

11. The forcible entry tool defined in claim 10 wherein said handle further includes a plurality of sections and means for coupling adjacent sections together.

12. The forcible entry tool defined in claim 10 wherein said cap includes a plurality of handle connection means, and said housing includes a plurality of handle connection means.

13. The forcible entry tool defined in claim 12 wherein said housing has a rectangular cross section.

14. The forcible entry tool defined in claim 6 further including a plurality of handles.

15. The forcible entry tool defined in claim 14 wherein said housing further includes a weighted extension on said housing aft end.

16. The forcible entry tool defined in claim 15 wherein two of said plurality of handles are connected at one end thereof to said weighted extension and at another end thereof to said housing.

17. The forcible entry tool defined in claim 16 wherein two additional handles are connected at both ends thereof to said housing.

18. The forcible entry tool defined in claim 3 further including a work element attaching means on said rod element near said forward end.

19. The forcible entry tool defined in claim 18 further including a forcible entry work element releasably mounted on said rod element forward end.

20. The forcible entry tool defined in claim 19 wherein said forcible entry work element includes a rhinoceros hook.

21. The forcible entry tool defined in claim 19 wherein said forcible entry work element includes a hook.

22. The forcible entry tool defined in claim 19 wherein said forcible entry work element includes a ram.

23. The forcible entry tool defined in claim 21 wherein said hook includes a bail.

24. The forcible entry tool defined in claim 1 wherein said housing further includes closing means closing said fore end, said closing means including a bore defined therethrough for slidably accommodating said rod element.

25. A hand-held forcible entry tool comprising:

A) a hollow housing having
   (1) an aft end, a fore end and a wall connecting said aft end and said fore end, and a longitudinal axis extending between said aft end and said fore end,
   (2) a blind-ended bore extending along said longitudinal axis from said fore end toward said aft end and having a bottom adjacent to said aft end, and
   (3) a stop means on said housing adjacent to said fore end and extending into said bore;

B) a rod element slidably positioned in said bore to move along said longitudinal axis toward and away from said bottom, said rod element slidably extending through said stop means and including
   (1) a forward end and a rear end, said rear end being positioned within said bore, and
   (2) an abutment means on said rod element adjacent to said rod element rear end, said abutment means being sized to slidably engage with said housing adjacent to said bore and to abut said stop means while still within said bore;

C) rod connection means for coupling said rod to said housing, said connection means including a first bore extending through said housing wall near said housing fore end, a second bore defined in said rod element and a pin element adapted to extend through said first bore and into said second bore;

D) a center of gravity of said housing having said rod element positioned therein; and E) means for moving said center of gravity towards said housing aft end.

26. The forcible entry tool defined in claim 5 wherein each projection is located adjacent to one of said corners.

* * * * *